US006835080B1

(12) United States Patent
Chang

(10) Patent No.: US 6,835,080 B1
(45) Date of Patent: Dec. 28, 2004

(54) SOUND SOURCE CONNECTOR WITH CUTOVER SWITCH

(75) Inventor: Chih-Kai Chang, Lujhu (TW)

(73) Assignee: Speed Tech Corp., Taoyuan Hsien (TW)

( * ) Notice: Subject to any disclaimer, the term of this patent is extended or adjusted under 35 U.S.C. 154(b) by 0 days.

(21) Appl. No.: 10/807,200

(22) Filed: Mar. 24, 2004

(51) Int. Cl.[7] ..... H01R 29/00
(52) U.S. Cl. ..... 439/188; 439/668
(58) Field of Search ..... 439/188, 668, 439/669

(56) References Cited

U.S. PATENT DOCUMENTS 6,422,902 B1 * 7/2002 Ogren et al. ..... 439/668

* cited by examiner

*Primary Examiner*—Tho D. Ta
(74) *Attorney, Agent, or Firm*—Troxell Law Office PLLC

(57) ABSTRACT

A sound source connector with cutover switch comprising at least a plastic housing, a flexible terminal, a contact terminal, and two signal terminals. Interior of the plastic housing is defined with retaining grooves for inserting the contact terminal and the two signal terminals, and also embodies a main receptacle for plugging a butt sound source plug therein. An insulated protruding arm extends toward interior of the main receptacle of the plastic housing. The insulated protruding arm of the plastic housing and the flexible terminal are mutually close, and moreover, the flexible terminal is adjacent to the contact terminal. The two signal terminals extend into the interior of the main receptacle of the plastic housing. Upon the sound source plug pushing on the insulated protruding arm, the flexible terminal comes in contact with the contact terminal, thereby enabling the flexible terminal and the contact terminal to transmit same signals.

8 Claims, 7 Drawing Sheets

SOUND SOURCE CONNECTOR WITH CUTOVER SWITCH

BACKGROUND OF THE INVENTION (a) Field of the Invention

The present invention relates to a sound source connector with cutover switch, and more particularly to the sound source connector for usage in electronic devices provided with functionality to broadcast sound.

(b) Description of the Prior Art

Because of rapid development in electronic technology, conventional electronic devices provided with functionality to broadcast sound, such as computers, DVD players, notebook computers, and so on, along with associated sound box, apart from being provided with 5-1 tracks, present systems are provided with functionality to represent 7-1 tracks in order to meet demands for more diversified functionality and a more complete representation of audio tracks, and thus provide a user with even greater listening enjoyment.

Referring to FIGS. 1, 2 and 3, which show a sound source connector for the conventional electronic device constructed to primarily comprise a plastic housing 1, two signal terminals 6 and 7, and two switches A and B. A main receptacle 11 is defined within the plastic housing 1, and which provides for a butt sound source plug 9 to plug thereinto. A portion of the aforementioned two signal terminals 6 and 7 are flexed so as to extend within the main receptacle 11 of the aforementioned plastic housing 1, and therewith an electrical connection with the sound source plug 9 is formed. Prior to the sound source plug 9 being inserted into the main receptacle 11 of the plastic housing 1 the aforementioned two switches A and B are electrically connected to the first signal terminal 6 and the second signal terminal 7 respectively.

Upon the sound source plug 9 being inserted into the conventional sound source connector, a top extremity of the sound source plug 9 pushes apart and thereby separates the first signal terminal 6 and the second signal terminal 7 from the switches A and B respectively. A change in signal resulting from the first signal terminal 6 separating from the switch A and the second signal terminal 7 separating from the switch B thereby enables an electric circuit configured atop a circuit board to detect insertion of the sound source plug 9. After the electric circuit on the circuit board detects insertion of the sound source plug 9, the electric circuit commences receiving and handling signals transmitted into the two signal terminals 6 and 7.

The conventional sound source connector as described has at least the following design shortcomings: requirement for a detection circuit to simultaneously detect separation of the first signal terminal 6 from the switch A and separation of the second signal terminal 7 from the switch B, which only then actualizes detection of insertion of the sound source plug 9, and thus probability of malfunction is high; and design of the detection circuit is complicated. Hence, there is a need for improvement in design and configuration of the conventional sound source connector and switch.

SUMMARY OF THE INVENTION

A primary objective of the present invention is to provide a sound source connector with cutover switch, the sound source connector having a simple detection switch, which therewith lowers probability of malfunction in the detection switch occurring.

Another objective of the present invention is to provide the sound source connector with cutover switch, whereby the cutover switch is simplified, and which thereby enabling simplification of a detection circuit atop a circuit board, the detection circuit being configured to detect insertion of a sound source plug.

The sound source connector with cutover switch of the present invention is constructed to include a plastic housing, a flexible terminal, a contact terminal and two signal terminals. Interior of the plastic housing is adapted to provide for containing and securing the aforementioned flexible terminal, and is further defined with retaining grooves that provide for inserting the contact terminal and the two signal terminals thereinto, and also embodies a main receptacle that provides for plugging a butt sound source plug thereinto. The two aforementioned signal terminals both extend within the main receptacle, thereby upon the sound source plug being plugged into the sound source connector, the two signal terminals are able to form an electrical connection with the sound source plug. An insulated protruding arm is configured in the plastic housing of the present invention so as to extend into the main receptacle of the plastic hosing, and the flexible terminal pushes down on the insulated protruding arm configured in the plastic housing. The flexible terminal and the contact terminal are configured within the main receptacle of the plastic housing so as to be mutually close. Upon the sound source plug being inserted into the main receptacle of the plastic housing, the sound source plug pushes on the insulated protruding arm, thereby enabling the flexible arm to come in contact with the contact terminal, and thus realizes a mutual connection between the flexible terminal and the contact terminal, thus achieving objective of the cutover switch.

The present invention embraces numerous varied embodiments of equal effectiveness, wherein the flexible terminal can be separated into two portions comprising a flexible member and a first connecting terminal, the flexible member being utilized to reciprocate squeezing of the insulated protruding arm of the plastic housing, thereby enabling the insulated protruding arm to extend into the main receptacle, and the first connecting terminal can then form an electrical connection with the flexible arm and a printed circuit board, thus enabling even easier punch manufacture of the flexible terminal. By same principle, the contact terminal can also be separated into two electrically connected portions comprising a contact member and a second connecting terminal.

In order to facilitate mutual contact between the flexible terminal and the contact terminal when the sound source plug is inserted into the main receptacle of the plastic housing, a protruding piece can be configured atop the insulated protruding arm, wherewith the protruding piece increases extent of flexible deformation of the flexible arm of the insulated protruding arm or the flexible terminal.

Furthermore, in order to increase service life of the sound source connector, and to prevent damage to the insulated protruding arm of the plastic arm from fatigue, insert molding can be utilized or other mechanical engineering methods to secure the insulated protruding arm on the flexible arm of the flexible terminal subject to flexible deformation, thereby enabling the insulated protruding arm together with the flexible terminal to be assembled within the plastic housing, thus preventing the flexible terminal and the sound source plug from directly coming into contact, and thereby preventing interference with signals transmitted from the sound source plug to the circuit board, To enable a further understanding of the said objectives and the technological methods of the invention herein, the brief description of the drawings below is followed by the detailed description of the preferred embodiments.

BRIEF DESCRIPTION OF THE DRAWINGS

FIG. 4-1 shows an enlarged elevational view of FIG. 4 of each terminal according to the present invention.

DETAILED DESCRIPTION OF THE PREFERRED EMBODIMENTS

Preferred embodiments of the present invention are disclosed hereinafter, and persons skilled in the art will conceive other advantages and functionality of the present invention from disclosures as described below, and thus further deduce other embodiments of the present invention.

Figure 1:
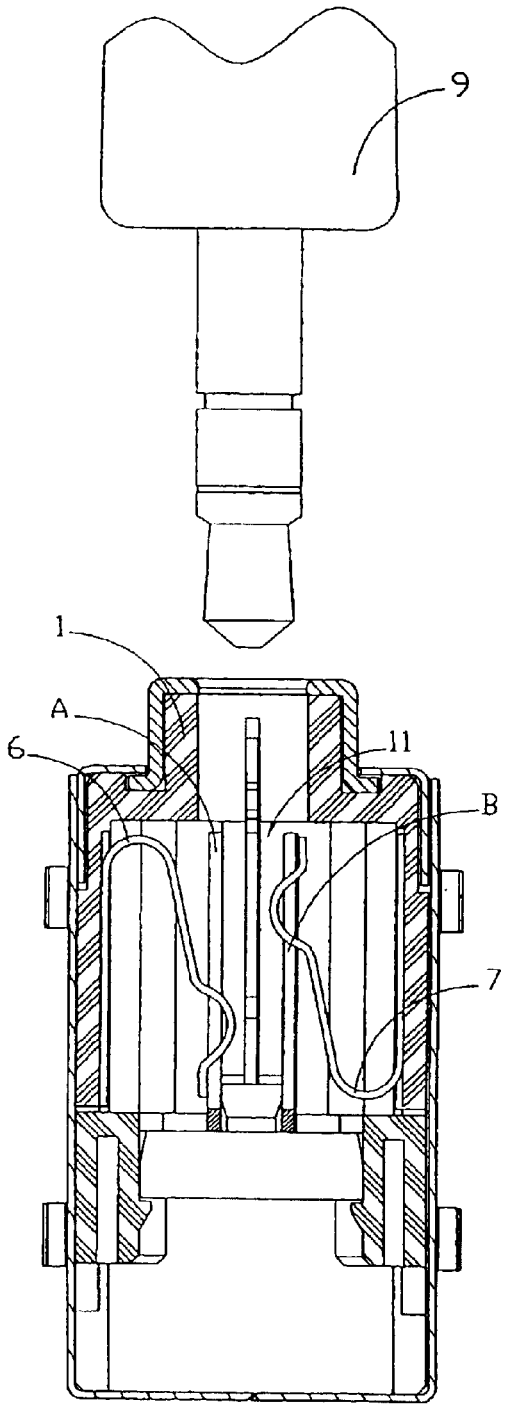
FIG.1 Prior Art
FIG. 1 shows a cross sectional schematic view of a conventional sound source connector in usage.
Figure 4:
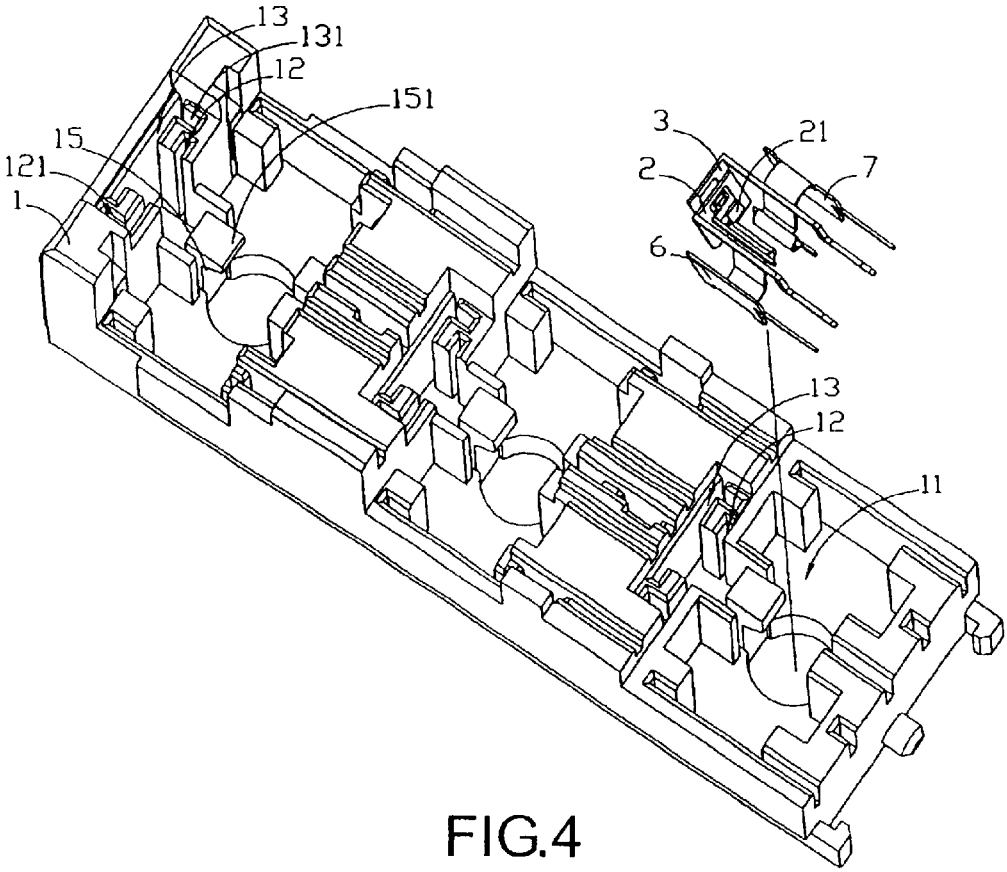
FIG. 4 shows a schematic view of an insulated housing and assembling of each terminal of a first preferred embodiment according to the present invention.
Figures 1, 4:
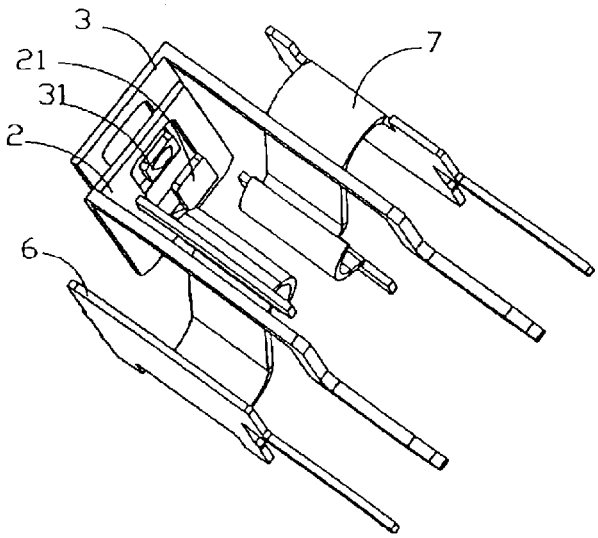

Referring to FIGS. 4 and 4-1, which show an example of an embodiment of the present invention, and depict a three vertical-stacked same sound source connector. However, art of the present invention is not limited to usage in a single sound source connector or multi-stack sound source connector thereof.

Figure 2:
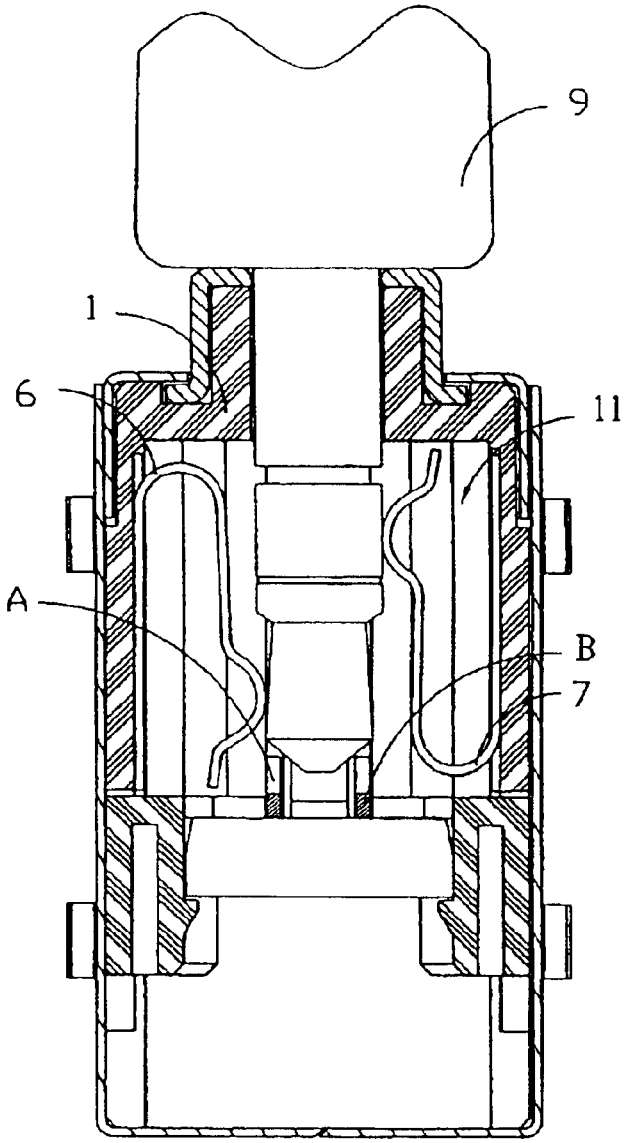
FIG.2 Prior Art
FIG. 2 shows another cross sectional schematic view of the conventional sound source connector in usage.
Figure 3:
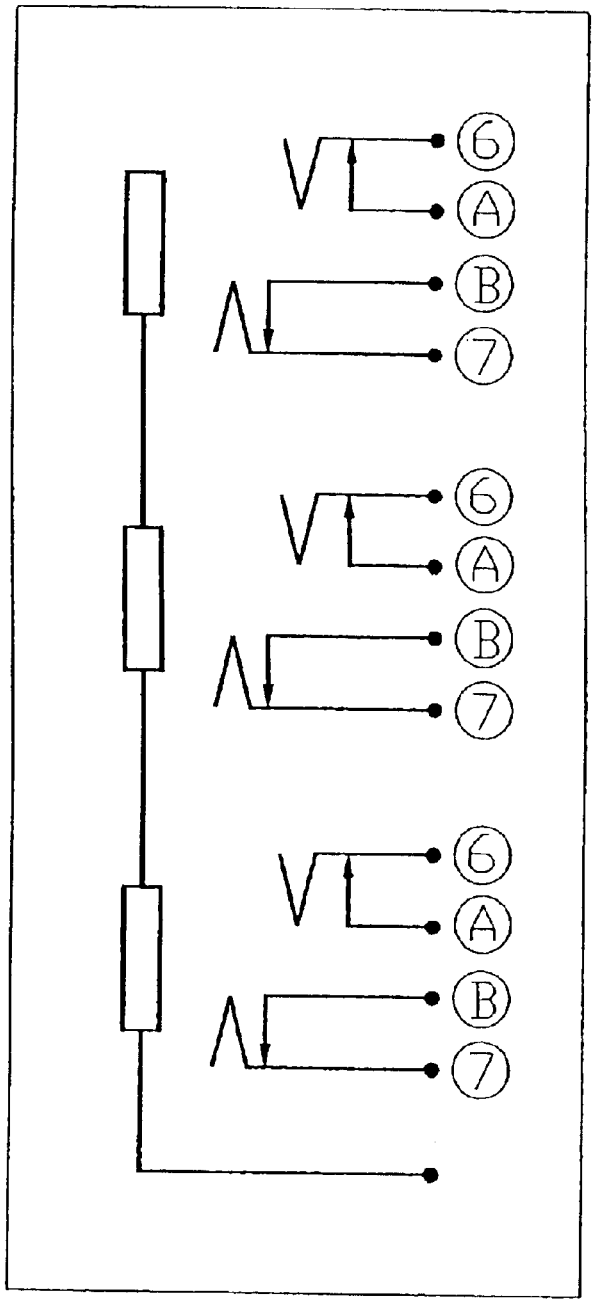
FIG.3 Prior Art
FIG. 3 shows a simplified switch circuit diagram of the conventional sound source connector.

A preferred embodiment of the present invention is constructed to primarily comprise a plastic housing 1, a flexible terminal 2, a contact terminal 3, and two signal terminals 6 and 7. A first retaining groove 12 and a second retaining groove 13 are configured within the plastic housing 1 of the preferred embodiment, and which are adapted to contain the aforementioned flexible terminal 2 and the flexible terminal 3 respectively therein. A main receptacle 11 is further defined within the plastic housing 1, and which is adapted for inserting and butt joining a sound source plug 9 therein (not shown in FIGS. 4 and 4-1, but as depicted in FIGS. 1 and 2). Moreover, the aforementioned two signal terminals 6 and 7 both extend towards an interior of the main receptacle 11 of the plastic housing 1. Hence, upon plugging in the sound source plug 9, the two signal terminals 6 and 7 thereat form an electrical connection with the sound source plug 9.

Figure 5:
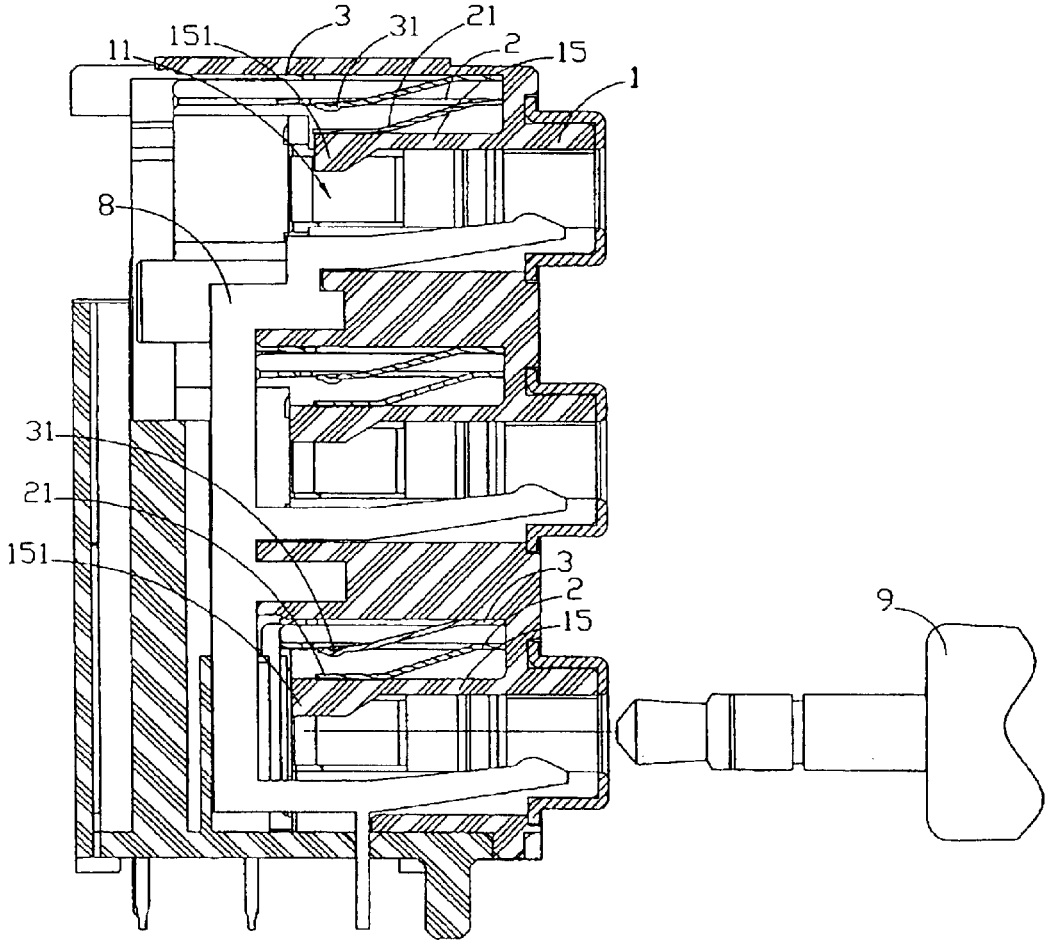
FIG. 5 shows a cross sectional view of the terminal of FIG. 4 after assembling according to the present invention.

Referring to FIG. 5, which shows a flexible arm 21 configured on the flexible terminal 2 of the preferred embodiment, moreover, a flexible arm 31 is configured on the contact terminal 3 so as to correspond to the flexible arm 21 of the flexible terminal 2. In a normal state, the two flexible arms 21 and 31 are mutually separated but at a close distance from each other. The aforementioned flexible arm 21 of the flexible terminal 2 pushes on an insulated protruding arm 15 configured in the plastic housing 1, thereby enabling the insulated protruding arm 15 to extend into the main receptacle 11 of the plastic housing 1. During course of plugging in the sound source plug 9 into the main receptacle 11 of the sound source connector, the sound source plug 9 is subjected to a countercheck from the insulated protruding arm 15 of the plastic housing 1 and a pushing force is produced thereof. The insulated protruding arm 15 of the plastic housing 1 is thus subjected to the pushing force and flexibly distorts, thereby squeezing on the flexible arm 21 of the flexible terminal 2. The flexible arm 21 of the flexible terminal 2 flexibly distorts upward and thereby comes into contact with the flexible arm 31 of the contact terminal 3, and thus realizes an electrical connection between the flexible terminal 2 and the contact terminal 3, further enabling an electric circuit of a circuit board to detect a signal transmitted from the electrical connection between the flexible terminal 2 and the contact terminal 3, and which thus confirms that the sound source plug 9 has already been inserted into the main receptacle 11 of the plastic housing 1.

A design objective of the flexible arm 31 of the contact terminal 3 of the preferred embodiment is to achieve an easy electrical connection between the flexible terminal 2 and the contact terminal 3. However, to achieve such objective without necessarily configuring the flexible arm 31 on the contact terminal 3, persons skilled in related art can easily deduce that by utilizing a shape of the flexible arm 21 formed from bending the flexible terminal 2, need for the flexible arm 31 to be configured on the contact terminal 3 can thus be eliminated.

An earth terminal 8 is configured within the main receptacle 11 of the plastic housing 1 of the preferred embodiment. Because the earth terminal 8 primarily carries static electricity or interference signals from the sound source plug 9 towards an earth circuit on the circuit board, therefore, within the preferred embodiment of the present invention, at least a three vertically stacked sound source connector with configured circuitry can collectively utilize the earth terminal 8.

Because a protruding piece 151 extends from an extremity of the insulated protruding arm 15 of the plastic housing 1 of the preferred embodiment, and because the protruding piece 151 of the insulated protruding arm 15 extends deeply towards the main receptacle 11 of the plastic housing 1, therefore, upon inserting the sound source plug 9, butt-squeezing between the sound source plug 9 and the insulated protruding arm 15 will intensify as a result, and thus the insulated protruding arm 15 will be subjected to an increased displacement force from the squeezing of the sound source plug 9.

Figure 6:
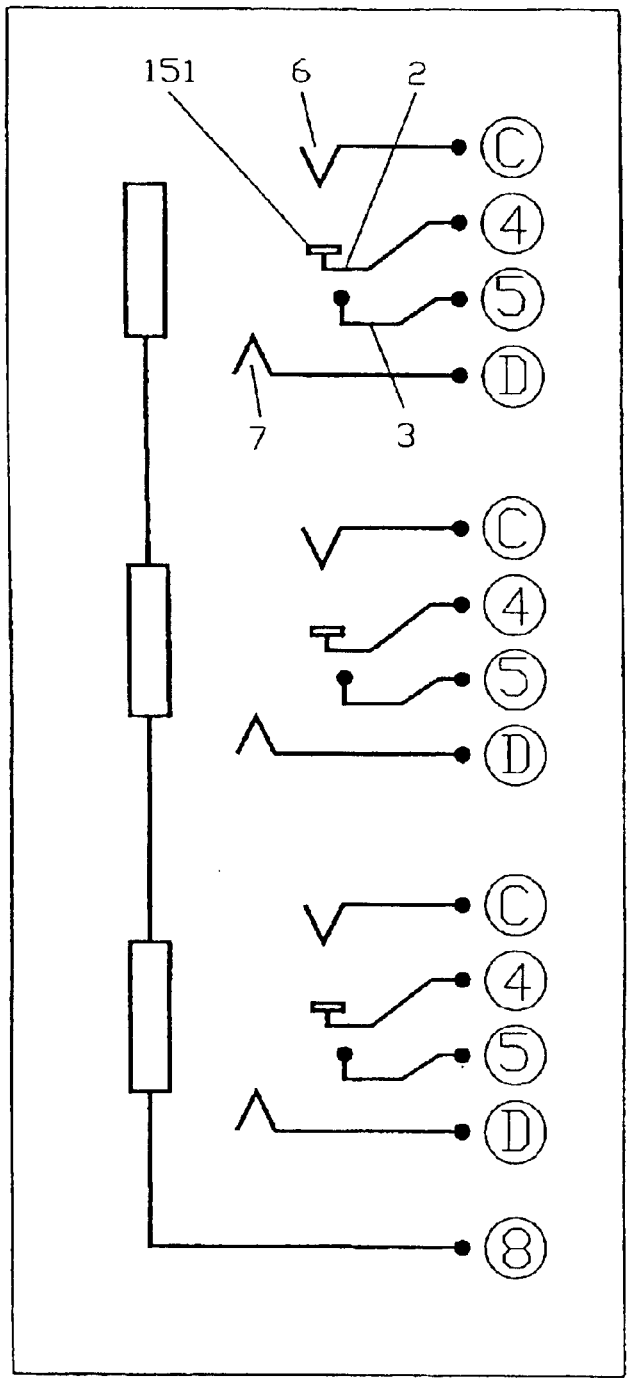
FIG. 6 shows a simplified switch circuit diagram according to the present invention.
Figure 7:
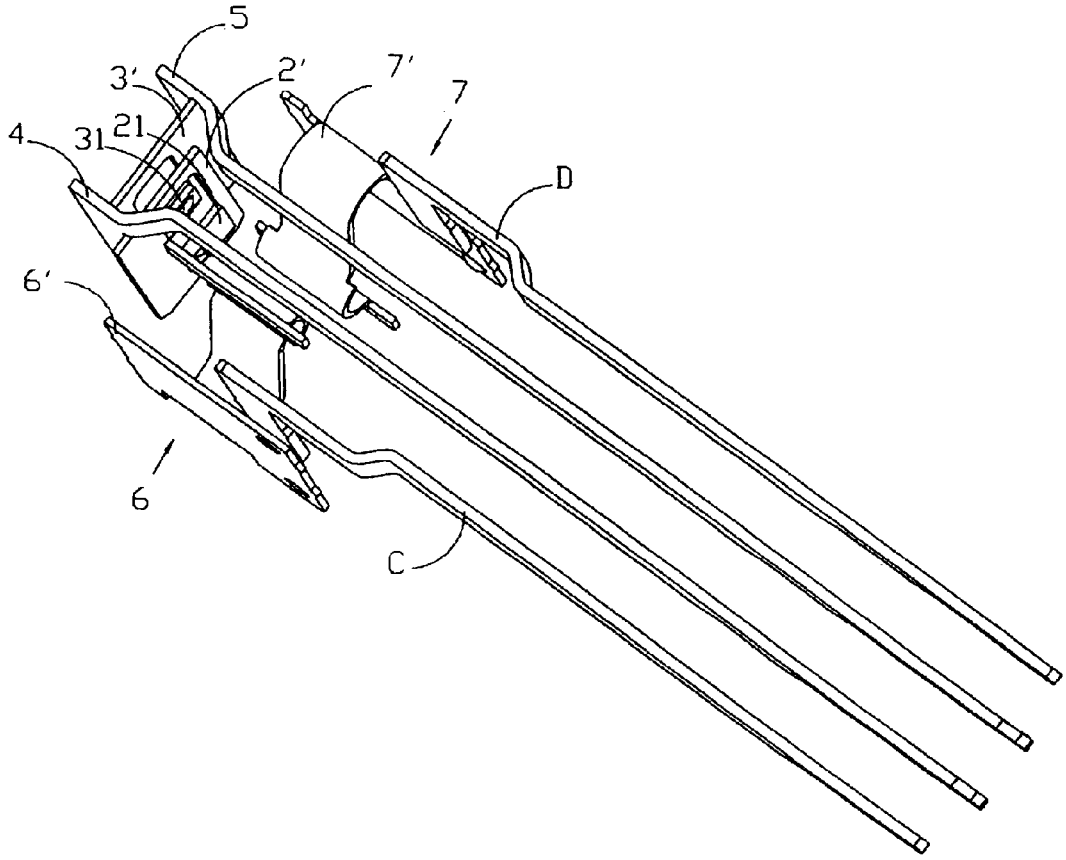
FIG. 7 shows an elevational view of a terminal of a second embodiment according to the present invention.

In accordance with aforementioned figures, and in addition referring to FIGS. 6 and 7, because mechanical punching production methods in common use by connector industry to punch out shapes of the flexible terminal 2 and the contact terminal 3 (see FIGS. 4 and 4-1) from sheet metal, an enormous wastage of material results, and moreover, mechanical strength of the flexible terminal 2 and the contact terminal 3 is comparatively weak. Production manufacturing cost will remain high if material the flexible terminal 2 and the contact terminal 3 are made from is changed or thicker sheet metal is used to resolve the aforesaid problems. However, another preferred embodiment of the present invention can resolve such problems, and is described hereinafter.

The other preferred embodiment of the present invention primarily embodies separate punch manufacture of the flexible terminal 2 into two sections and similarly that of the contact terminal 3 into two sections. Wherein punch manufacture of the flexible terminal 2 involves assemblage of a flexible member 2' with the flexible arm 21 and a first connecting terminal 4, thereby the flexible member 2' and the first connecting terminal 4 can be electrically connected and thus form the flexible terminal 2 that can be electrically connected to the circuit board. Because the flexible member 2' and shape of the first connecting terminal 4 are simpler in design when compared to the aforementioned embodiment, therefore less wastage in material results in comparison to wastage in material when manufacturing the flexible terminal 2. By same principle, the contact terminal 3 can also be constructed from an assemblage of a contact member 3' and a second connecting terminal 5, and which are electrically connected thereby forming the contact terminal 3 that is electrically connected to the circuit board.

During usage of the embodiment of the present invention, a rabbet 121 defined in one end of the first retaining groove 12 of the plastic housing 1 provides for the first connecting terminal 4 to securely lodge thereinto, and therewith ensures the electrical connection between the flexible member 2' and the first connecting terminal 4. By same principle, a rabbet 131 is appropriately defined in a second retaining groove 13, and which provides for the second connecting terminal 5 to securely lodge thereinto, therewith ensuring the electrical connection between the flexible member 3' and the second connecting terminal 5.

According to the aforementioned embodiment, because the flexible terminal 2 and the contact terminal 3 are punch manufactured so as to form two sections, wastage in material is minimized, and the mechanical strength of the flexible terminal 2 and the contact terminal 3 is increased. Hence, persons skilled in the art can easily deduce a similarly structured configuration for signal terminals 6 and 7.

Referring to FIG. 7, which shows the first signal terminal 6 constructed to include a first signal member 6' and a first bridge connecting terminal C; and a second signal terminal 7 constructed to include a second signal member 7' and a second bridge connecting terminal D, wherein, upon the sound source plug 9 being inserted into the sound source connector, the two signal terminals 6 and 7 are primarily used to transmit a signal from the sound source plug 9 to the printed circuit board for further utilization thereof. Hence, persons skilled in the art can easily design a normal electrical connection between the first signal member 6' and the bridge connecting terminal C similar to that between the flexible terminal 2 and the first connecting terminal 4.

According to aforementioned disclosures of the two preferred embodiments, the insulated protruding arm 15 of the plastic housing 1 of the present invention is primarily utilized to prevent the flexible terminal 2 from coming into direct contact with the sound source plug 9, and to further prevent the flexible terminal 2 from interfering with signals being transmitted from the sound source plug 9 to the circuit board, and thus not absolutely necessary for the insulated protruding arm 15 to extend from the plastic housing 1. According to aforementioned, any insulated material packed between the flexible terminal 2 and the sound source plug 9 can be utilized as the insulated protruding arm 15 of the present invention, for instance, including but not limited to an insert molding method being utilized on a portion of the flexible terminal 2 to mold an insulated material thereat, which can then be utilized to prevent contact between the flexible terminal 2 and the sound source plug 9. Persons skilled in the art can utilize other mechanical engineering methods to manufacture the insulated protruding arm 15.

The aforementioned embodiments disclose a simple sound source connector with detection switch, whereby the sound source connector achieves low probability of malfunction, and realizes simplification of a detection circuit on the circuit board, which is utilized to detect insertion of the sound source plug 9.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A sound source connector with cutover switch comprising at least a plastic housing, a flexible terminal, a contact terminal, and two signal terminals, wherein:

a main receptacle is defined within the plastic housing, and which is adapted for inserting a sound source plug therein; moreover, an insulated protruding arm is integrally formed in the plastic housing of the main receptacle;

the flexible terminal is fixed within the plastic housing, and the flexible terminal is configured to push down on the insulated protruding arm integrally formed in the plastic housing, thereby ensuring the insulated protruding arm stays within the main receptacle of the plastic housing; the contact terminal is fixed within the plastic housing, and upon the sound source plug being inserted into the sound source connector, the contact terminal forms an electrical connection with the aforementioned flexible terminal;

the two signal terminals are fixed within the plastic housing, and respectively extend towards an interior of the main receptacle of the plastic housing, and upon inserting the sound source plug into the main receptacle of the plastic housing, the two signal terminals respectively form an electrical connection with the sound source plug; the aforementioned flexible terminal, the contact terminal and the two signal terminals respectively form an electrical connection with an electric circuit of a printed circuit board.

2. The sound source connector with cutover switch according to claim 1, wherein a protruding piece is configured on an extremity of the insulated protruding arm of the plastic housing, whereby, upon inserting the sound source plug, the protruding piece increases extent of flexible deformation of the flexible arm of the flexible terminal.

3. The sound source connector with cutover switch according to claim 1, wherein the flexible terminal comprises a flexible member and a first connecting terminal, whereby the flexible member props against the flexible arm configured on back of the insulated protruding arm of the plastic housing, and the first connecting terminal electrically connects the flexible member with the electric circuit of the printed circuit board.

4. The sound source connector with cutover switch according to claim 1, wherein the contact terminal comprises a contact member and a second connecting terminal, whereby upon the sound source plug being inserted into the main receptacle of the plastic housing, the contact terminal forms an electrical connection with the flexible arm of the flexible terminal, and the second connecting terminal electrically connects the contact member with the electric circuit of the printed circuit board.

5. The sound source connector with cutover switch according to claim 1, wherein the first signal terminal makes the electrical connection with the electric circuit of the printed circuit board through a bridge connecting terminal.

6. The sound source connector with cutover switch according to claim 1, wherein the second signal terminal makes the electrical connection with the electric circuit of the printed circuit board through a bridge connecting terminal.

7. A sound source connector with cutover switch comprising at least the plastic housing, the flexible terminal, the contact terminal, and the two signal terminals, wherein:

a main receptacle is defined within the plastic housing; the flexible terminal is fixed within the plastic housing, and the flexible arm is configured on the flexible terminal, an insulated piece is fixedly configured on an extremity of the flexible arm of the flexible terminal so as to inwardly face interior of the main receptacle of the plastic housing, and the insulated piece of the flexible terminal maintains within interior of the main receptacle of the plastic housing;

the contact terminal is fixed within the plastic housing, and upon the sound source plug being inserted into the sound source connector, the contact terminal forms an electrical connection with the aforementioned flexible terminal;

the two signal terminals are fixed within the plastic housing, and respectively extend towards an interior of the main receptacle of the plastic housing, and upon inserting the sound source plug into the main receptacle of the plastic housing, the two signal terminals respectively form an electrical connection with the sound source plug; the aforementioned flexible terminal, the contact terminal and the two signal terminals respectively form an electrical connection with an electric circuit of a printed circuit board.

8. The sound source connector with cutover switch according to claim 7, wherein the insulated piece of the flexible terminal is configured by means of an insert molding on the flexible arm of the flexible terminal.

* * * * *